US009056384B1

(12) United States Patent
Ribeiro

(10) Patent No.: US 9,056,384 B1
(45) Date of Patent: Jun. 16, 2015

(54) APPARATUS AND METHOD FOR SANDING EDGES OF A PANEL

(71) Applicant: Tacha Holdings Inc., Cambridge (CA)

(72) Inventor: Carlos Ribeiro, Cambridge (CA)

(73) Assignee: Tacha Holdings Inc., Cambridge, Ontario (CA)

( * ) Notice: Subject to any disclaimer, the term of this patent is extended or adjusted under 35 U.S.C. 154(b) by 34 days.

(21) Appl. No.: 14/151,990

(22) Filed: Jan. 10, 2014

(51) Int. Cl.
*B24B 27/00* (2006.01)
*B24B 47/16* (2006.01)
*B24B 23/03* (2006.01)

(52) U.S. Cl.
CPC ..... *B24B 47/16* (2013.01); *B24B 27/0076* (2013.01); *B24B 23/03* (2013.01)

(58) Field of Classification Search
CPC B24B 19/24; B24B 27/0076; B24B 27/0023; B24B 5/42; B24B 7/28; B24B 21/008
USPC ..... 451/57, 336, 65, 121, 357, 334, 130, 451/270, 166; 144/286.5
See application file for complete search history.

(56) References Cited

U.S. PATENT DOCUMENTS

| | | | | |
|---|---|---|---|---|
| 2,070,944 | A * | 2/1937 | Hillix | 451/28 |
| 2,170,687 | A * | 8/1939 | Johnson | 144/135.3 |
| 3,074,210 | A | 1/1963 | Eschenburg et al. | |
| 4,114,665 | A | 9/1978 | Decker | |
| 4,305,231 | A * | 12/1981 | Rasmussen | 451/65 |
| 4,335,765 | A | 6/1982 | Murphy | |
| 5,081,794 | A * | 1/1992 | Haney | 451/166 |
| 5,199,220 | A * | 4/1993 | Steiner et al. | 451/65 |
| 5,653,273 | A * | 8/1997 | Bach | 144/1.1 |
| 5,733,180 | A * | 3/1998 | Kilde | 451/65 |
| 5,916,014 | A | 6/1999 | Schroeder et al. | |
| 6,102,787 | A | 8/2000 | Schroeder et al. | |
| 6,200,206 | B1 | 3/2001 | Drees | |
| 6,386,958 | B1 | 5/2002 | Wang | |
| 6,533,648 | B2 * | 3/2003 | Drees | 451/182 |
| 6,749,492 | B2 * | 6/2004 | Chiang | 451/296 |
| 6,854,701 | B2 | 2/2005 | Brockmann | |
| 6,857,456 | B2 | 2/2005 | Manning | |
| 7,001,249 | B1 * | 2/2006 | Pride et al. | 451/21 |
| 7,198,557 | B2 | 4/2007 | Haney | |
| 7,207,875 | B2 | 4/2007 | Melvin et al. | |
| 2002/0102929 | A1 * | 8/2002 | Wang | 451/65 |
| 2012/0184188 | A1 * | 7/2012 | Chou | 451/359 |
| 2013/0059505 | A1 | 3/2013 | Bailey | |

* cited by examiner

*Primary Examiner* — George Nguyen
(74) *Attorney, Agent, or Firm* — Bereskin & Parr LLP/S.E.N.C.R.L., s.r.l.

(57) ABSTRACT

Described herein is an apparatus for sanding an edge of a panel. The apparatus includes a base having a horizontal support surface for supporting the panel, and a fence mounted to the base. The fence has a vertical guide surface for engaging the edge of the panel. The fence also has at least one vertical slot along the vertical guide surface. The apparatus also includes at least one orbital sander positioned within the vertical slot for sanding the edge of the panel, and a linear actuator for reciprocating the orbital sander within the vertical slot along a vertical path. In use, the panel is moved along the base and the panel edge engages the fence while the sander oscillates and reciprocates to sand the panel edge.

20 Claims, 7 Drawing Sheets

APPARATUS AND METHOD FOR SANDING EDGES OF A PANEL

TECHNICAL FIELD

The disclosure herein relates to apparatus and methods for sanding edges of panels such as kitchen cupboard doors.

INTRODUCTION

When manufacturing kitchen cupboard doors and other panels it is common to sand surfaces of the panel after cutting or milling the panel. This can help provide a better surface finish. Sanding the panel can be particularly useful when applying paint, stains, or other coatings because sanded surfaces tend to use less paint than unsanded surfaces. For example, less paint tends to be absorbed by the panel when the surfaces have been sanded. In some cases, the panel may be sanded between each coating of paint. For example, a primer may be applied to a panel made of medium density fiberboard (MDF), and the primer may be gently sanded prior to applying additional coatings of paint to the MDF panel.

In some cases, the surfaces are sanded using a coated abrasive, such as sand paper. Typically, the sand paper is moved back and forth across the surface of the object, abrading the surface, and thereby making it smooth. In some cases, the surfaces are sanded by hand. However, manual hand sanding can be labor intensive and costly. Furthermore, sanding surfaces by hand tends to lead to inconsistent or uneven surfaces.

Machines have been developed to sand surfaces of panels. For example, U.S. Pat. No. 6,200,206 (Drees) discloses a surface finishing apparatus for finishing the surfaces of work-pieces such as cabinet doors. The apparatus includes a plurality of relatively large, lightweight finishing platens that are simultaneously movable in both a reciprocal and an orbital-like motion to sand work-pieces. As shown in FIG. 2B of Drees, the apparatus is configured to sand the large front and back surfaces of the panel. One problem is that the narrower side surfaces along the edges of the panel remain rough. Accordingly, it is common to sand the panel edges by hand after using an apparatus such as Drees. However, as described above, hand sanding can lead to inconsistent quality while also being labor intensive and costly.

Accordingly, there is a need for new or improved apparatus and methods for sanding the edges of panels such as kitchen cupboard doors.

SUMMARY

According to one aspect, there is provided an apparatus for sanding an edge of a panel. The apparatus includes a base having a horizontal support surface for supporting the panel, and a fence mounted to the base. The fence has a vertical guide surface for engaging the edge of the panel. The fence also has at least one vertical slot along the vertical guide surface. The apparatus also includes at least one orbital sander positioned within the vertical slot for sanding the edge of the panel, and a linear actuator for reciprocating the orbital sander within the vertical slot along a vertical path.

The orbital sander may include at least two orbital sanders. The two orbital sanders may have different sanding grits.

The apparatus may include a depth adjustment mechanism for adjusting a lateral offset between the orbital sander and the vertical guide surface. For example, the orbital sander may be mounted within a sander support bracket. In such cases, the depth adjustment mechanism may include a depth adjustment plate positioned laterally adjacent to the sander support bracket. The depth adjustment plate may have at least one bore hole therethrough. The depth adjustment mechanism may also include at least one biasing element for biasing the depth adjustment plate apart from the sander support bracket, and at least one threaded fastener extending through the bore hole and being adjustably threaded into the sander support bracket for counteracting the biasing element and for adjusting lateral separation between the depth adjustment plate and the sander support bracket.

The linear actuator may be a crank-slider mechanism for reciprocating the orbital sander along the vertical path. For example, the crank-slider mechanism may include: a vertical guide; a rotor for generating rotary motion; a connecting arm having a proximal end pivotally coupled to the rotor and a distal end; and a slider block pivotally coupled to the distal end of the connecting arm and slidably mounted along the vertical guide. The orbital sander may be mounted to the slider block for reciprocating the orbital sander within the vertical slot along the vertical path in response to the rotary motion of the rotor.

The apparatus may include a counter-balance mechanism for supporting the orbital sander along the vertical path.

The apparatus may include a router positioned along the vertical guide surface for routing the panel.

The apparatus may include an automatic feeder for feeding the panel along the vertical guide surface.

According to another aspect, there is provided an apparatus for sanding a panel. The apparatus includes a base having a support surface for supporting the panel, and a fence having a guide surface transverse to the support surface of the base for engaging an edge of the panel. The fence also has a sanding slot along the guide surface. The apparatus also includes a sander positioned within the sanding slot for sanding the edge of the panel, and a linear actuator for reciprocating the sander within the sanding slot along a linear path that is parallel to the guide surface. The sander is configured to oscillate with a first range of motion, and the linear actuator has a second range of motion that is greater than the first range of motion.

The support surface may be horizontal. The guide surface may be vertical. The linear path may be a vertical path. The sander may be an orbital sander.

According to another aspect, there is provided a method for sanding an edge of a panel. The method includes: feeding the panel along a support surface; guiding the edge of the panel along a guide surface that is transverse to the support surface; and sanding the edge of the panel using a sander traveling along a sanding path that is parallel to the guide surface and transverse to the support surface. The sanding path is defined by a combination of: an oscillating motion having a first range of motion, and a linear reciprocation having a second range of motion that is greater than the first range of motion.

The sanding step may include: sanding the edge of the panel with a first sander having a first grit, and sanding the edge of the panel with a second sander having a second grit. The first grit may be more coarse than the second grit.

The sander may be an orbital sander that provides the oscillating motion, and the linear reciprocation may be provided by movement of the orbital sander along a linear path that is distinct from the oscillating motion of the orbital sander.

The oscillating motion may have a first frequency and the linear reciprocation may have a second frequency that is less than the first frequency.

Other aspects and features will become apparent, to those ordinarily skilled in the art, upon review of the following description of some exemplary embodiments.

BRIEF DESCRIPTION OF THE DRAWINGS

Some embodiments of the present specification will now be described, by way of example only, with reference to the following drawings, in which.

DETAILED DESCRIPTION

Figure 1:
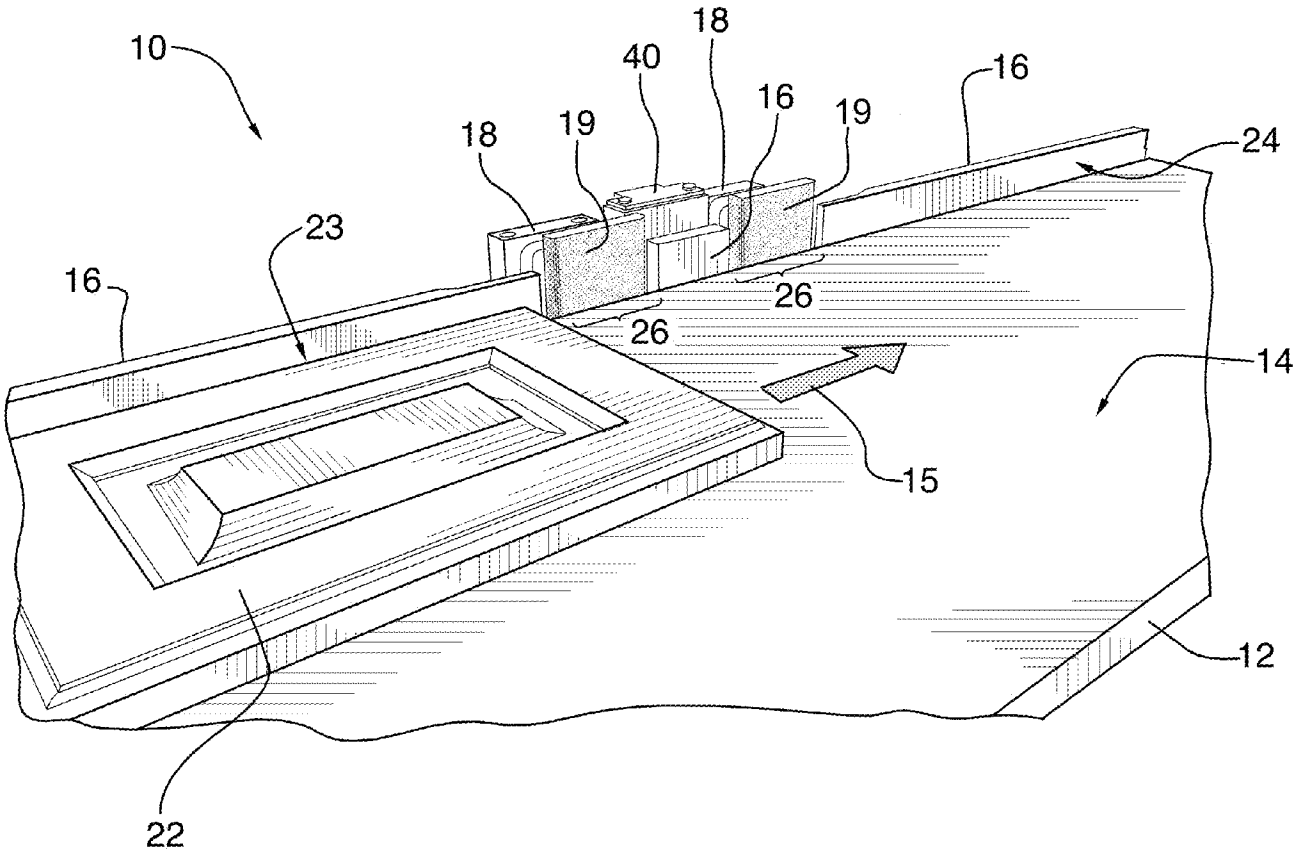
FIG. 1 is a front perspective view of an apparatus for sanding the edges of a panel, according to one embodiment.

Referring to FIG. 1, illustrated therein is an apparatus 10 for sanding a panel 22 such as a kitchen cupboard door. The apparatus 10 includes a base 12, a fence 16 mounted to the base 12, and two sanders 18. In use, the panel 22 is moved along a feed direction 15 while supported by the base 12. Furthermore, an edge 23 of the panel 22 engages the fence 16 while the sanders 18 oscillate to sand the panel edge 23. The panel edge 23 is generally a narrow side surface that is orthogonal or transverse to the front and back faces of the panel 22.

The base 12 may be a table or another type of structure for supporting the front or back faces of the panel 22 while being sanded. More particularly, the base 12 has a support surface 14 for supporting the panel 22. As shown, the support surface 14 may be horizontally oriented. This allows the panel 22 to lie flat on the support surface 14 while being sanded. In other embodiments, the support surface 14 may be non-horizontal. For example, the support surface 14 may be inclined towards the fence 16. In such cases, gravity might help pull the panel 22 towards the fence 16.

The fence 16 may be an elongate strip of material mounted to the base 12 (e.g. using fasteners such as bolts or clamps). The fence 16 generally has a guide surface 24 that is transverse to the support surface 14. More particularly, the guide surface 24 may be generally orthogonal to the support surface 14. In the illustrated embodiment, the guide surface 24 is vertically oriented.

In use, while the panel 22 moves along the support surface 14, the panel edge 23 is pressed against or otherwise engages the guide surface 24. This can help maintain movement of the panel 22 along a straight path that is parallel to both the support surface 14 and the guide surface 24.

The fence 16 also has one or more sanding slots 26 located along the fence 16. As shown, the sanders 18 are positioned within each sanding slot 26. In some cases, the sanding slots 26 may be vertical slots.

The sanders 18 may be orbital sanders such as palm sanders or another type of oscillating sander. More generally, the sanders 18 are configured to oscillate with a first range of motion for sanding the panel edge 23. The sanders 18 may have fixed or random oscillations/orbits.

The sanders 18 include a sanding surface 19 (e.g. sand paper) for engaging the panel edge 23. In use, while the panel 22 is moved along the support surface 14 and guide surface 24, the sanding surface 19 engages the panel 22 to sand the panel edge 23.

In some embodiments, the sanders 18 may have different sanding grits. For example, with reference to FIG. 1, the left sander 18 may have a coarse grit and the right sander 18 may have a finer grit. In other embodiments, the sanders 18 may have the same grit, or the grits may be reversed.

While the illustrated embodiment includes two sanders 18, there could be one or more sanders arranged along the fence 16.

Figure 2:
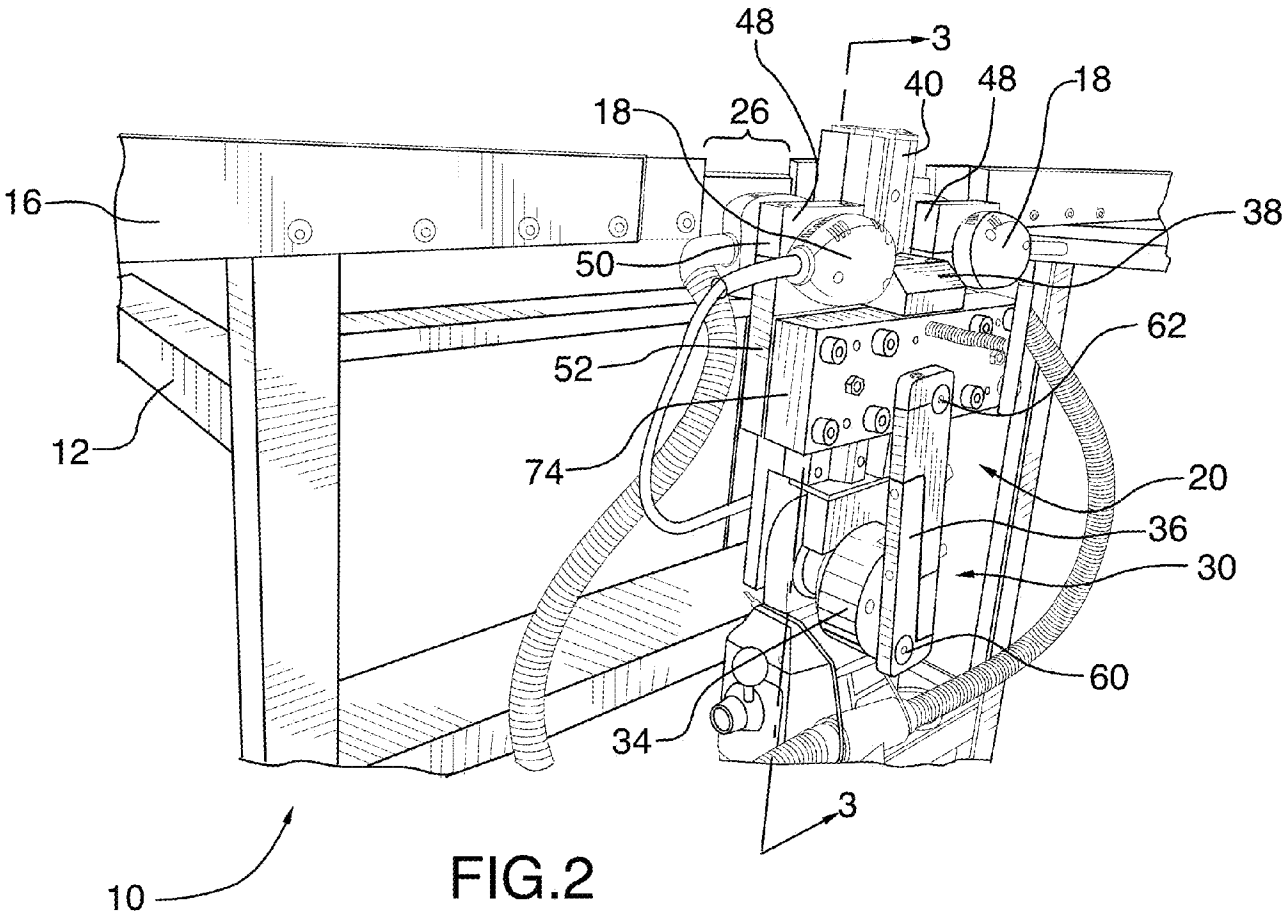
FIG. 2 is a rear perspective view of the apparatus of FIG. 1 showing a crank-slider mechanism for reciprocating orbital sanders up and down.

Referring now to FIG. 2, the apparatus 10 also includes a linear actuator 20 for reciprocating the sanders 18 along a linear path that is parallel to the guide surface 24. For example, the linear actuator 20 may reciprocate the sanders 18 within the vertical sanding slots 26 along a vertical path.

In general, the linear actuator 20 reciprocates the sanders 18 along a linear range of motion that is greater than the oscillating motion of the sanders 18. For example, the sanders 18 may oscillate or orbit with a first range of motion, which may be less than about 1-centimeter, or more particularly less than about 0.5-centimeters. In contrast, the linear actuator 20 may reciprocate the sanders 18 with a second range of motion, which may be greater than 1-centimeter, or more particularly up to about 10-centimeters. The combined types of motion may help improve the quality of sanding of the panel edge 23.

While the embodiments herein generally relate to sanders that have a combination of an oscillating motion (e.g. as provided by the orbital sander 18) and a reciprocating motion (e.g. as provided by the linear actuator 20), in other embodiments, the sanders may only reciprocate along the linear range of motion. For example, the orbital sanders 18 may be replaced by sanding pads. In such cases, the sanding pads may only reciprocate without oscillating.

Figure 3:
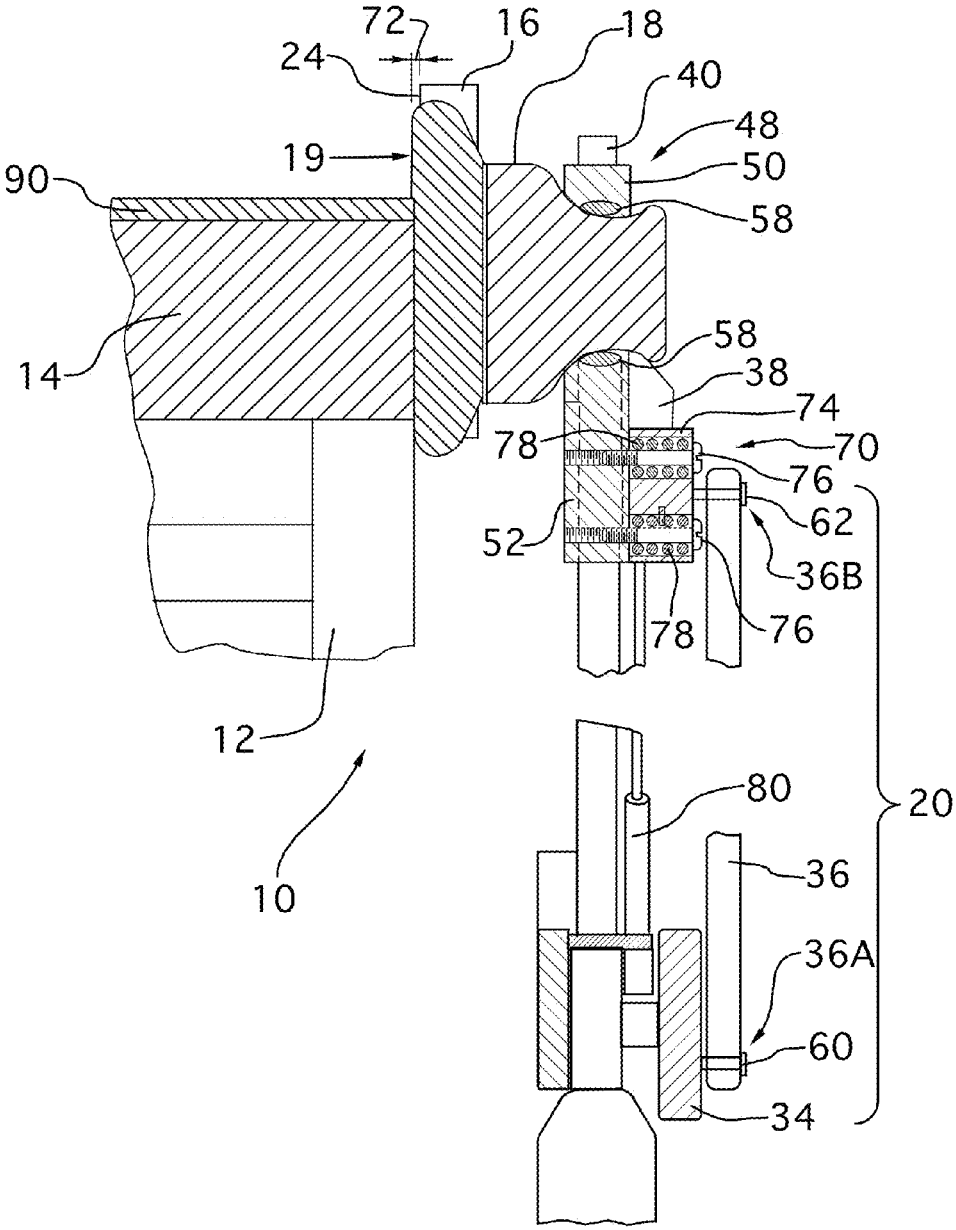
FIG. 3 is cross-sectional view of the apparatus of FIG. 2 along the line 3-3.
Figure 4:
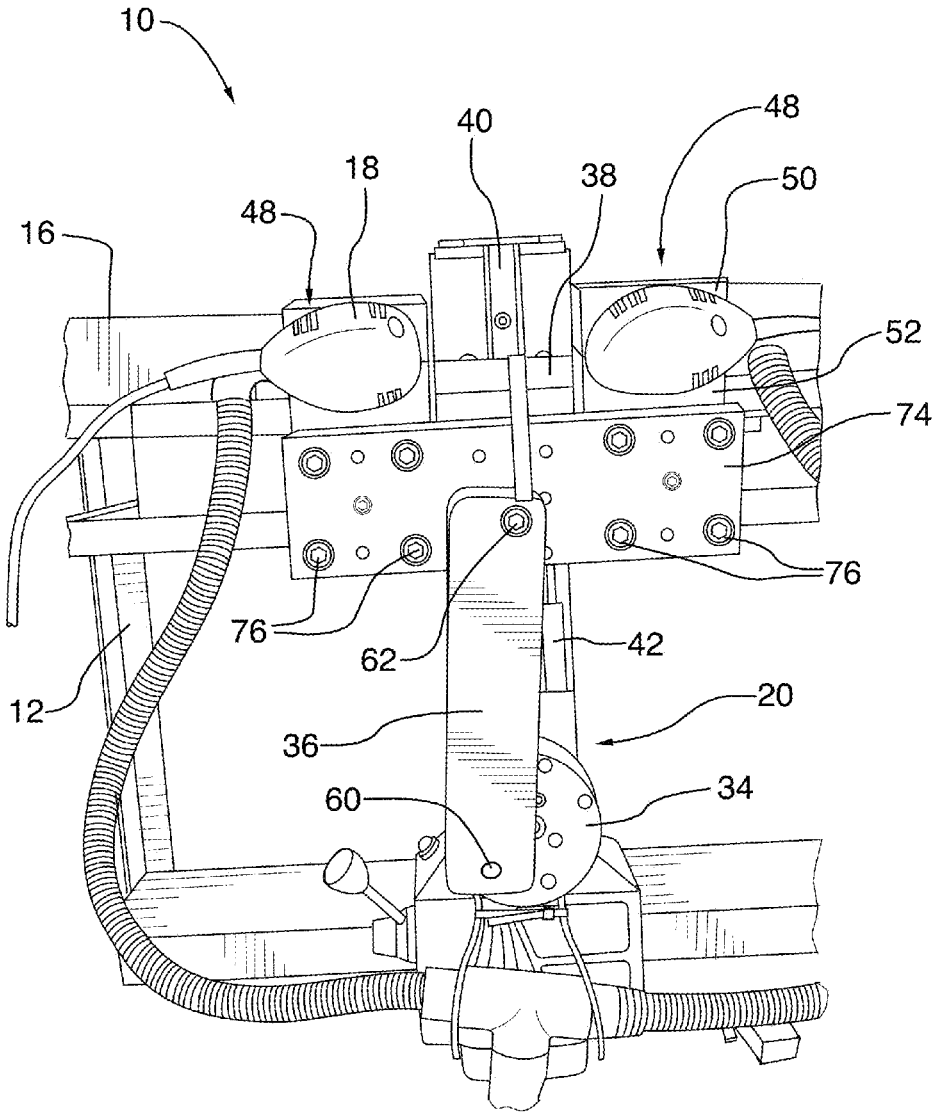
FIG. 4 is another rear perspective view of the apparatus of FIG. 1.
Figure 5:
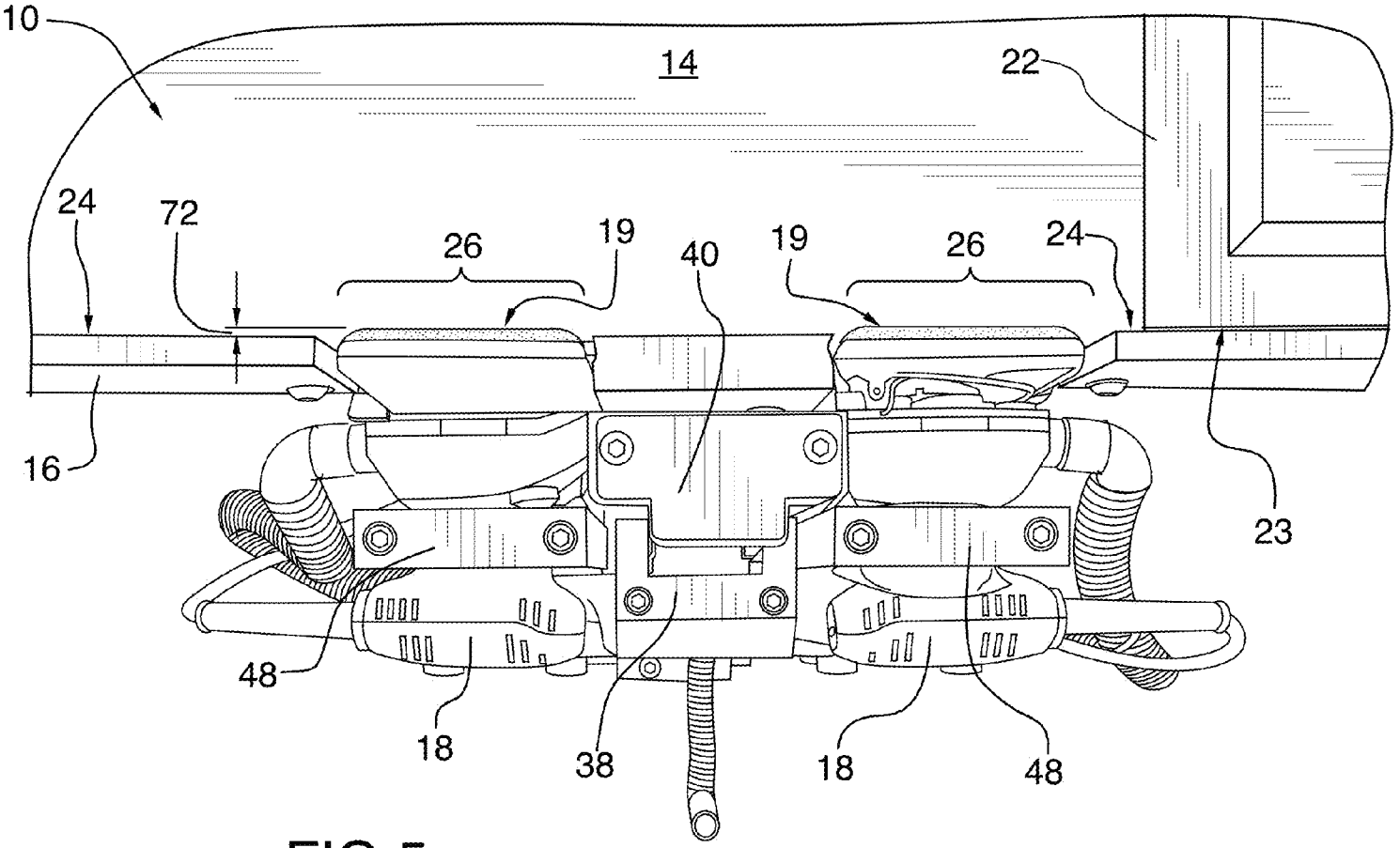
FIG. 5 is a top perspective view of the apparatus of FIG. 1.

As shown in the illustrated embodiment, the linear actuator 20 includes a crank-slider mechanism 30 for reciprocating the sanders 18 along the linear path. The crank-slider mechanism 30 converts rotational motion into linear motion. As shown in FIGS. 2-4, the crank-slider mechanism 30 includes a rotor 34, a connecting arm 36 pivotally coupled to the rotor 34, a slider block 38 pivotally coupled to the connecting arm 36, and a vertical guide 40.

The rotor 34 is coupled to a source of rotary motion such as a motor (e.g. a variable speed motor), which may be powered by electricity, hydraulics, pneumatics, and the like. The rotor 34 could also be replaced by a crank arm.

The connecting arm 36 is an elongate member pivotally coupled to the rotor 34 and the slider block 38. More particularly, with reference to FIG. 3, the connecting arm 36 has a proximal end 36A pivotally coupled to the rotor 34 at a first pivot point 60, and a distal end 36B pivotally coupled to the slider block 38 at a second pivot point 62. The first pivot point 60 is generally offset from the axis of rotation of the rotor 34.

The slider block 38 is slidably mounted to the vertical guide 40. The vertical guide 40 is located behind the fence 16 adjacent to the sanders 18. The vertical guide 40 may be a guide rail or another type of track or structure for limiting movement of the slider block 38 along a linear path. In some embodiments, the slider block 38 or the vertical guide 40 may include a low friction surface, bearings, or another device for facilitating sliding motion along the vertical guide 40.

In use, the rotor 34 generates rotary motion causing movement of the connecting arm 36 and the slider block 38. In particular, the connecting arm 36 causes the slider block 38 to move in a reciprocal fashion in a path that is defined by the vertical guide 40.

The range of motion of the crank-slider mechanism 30 is based upon the distance between the axis of rotation of the rotor 34 and the first pivot point 60. Accordingly, in some embodiments, the rotor 34 may be configured with different locations for the first pivot point (e.g. by providing multiple threaded openings at different distances from the axis of rotation). This may allow adjustment of the range of motion of the slider block 38 (also referred to as "stroke length"). In such cases, the connecting arm 36 may also have an adjustable length. This may allow adjustment of the position for the upper and lower limits of the stroke length.

The sanders 18 are mounted to the slider block 38 such that the sanders 18 reciprocate within the vertical sanding slots 26 in response to rotary motion of the rotor 34. In the exemplary embodiment, as shown in FIG. 2, each sander 18 is mounted to the slider block 38 through a sander support bracket 48. Each sander support bracket 48 is a two-piece assembly, which includes an upper first portion 50 and a lower second portion 52 clamped together. The first portion 50 and the second portion 52 are separable, so that the sander 18 can be removably installed within the sander support bracket 48 by detaching and removing the first portion 50. The first portion 50 and the second portion 52 may be secured to each other using fasteners such as screws or bolts.

As shown in FIG. 3, an O-ring 58 may be placed between the first portion 50 and second portion 52 of the sander support bracket 48. This helps secure the sander 18 in place within the sander support bracket 48. The O-ring also helps isolate vibrations.

Referring still to FIG. 3, in some embodiments the apparatus 10 may include a depth adjustment mechanism 70 for adjusting a lateral offset 72 between the sander 18 and the guide surface 24. This allows adjustment of how much material is removed from the panel edge 23 when being sanded.

The depth adjustment mechanism 70 may include a depth adjustment plate 74 mounted between the linear actuator 20 and the sanders 18 for adjusting the lateral offset 72. As shown, the depth adjustment plate 74 is attached to the slider block 38 so that the sander 18 moves with movement of the slider block 38. Furthermore, the depth adjustment plate 74 is positioned laterally adjacent to the sander support bracket 48. More particularly, the depth adjustment plate 74 is mounted to the lower portion 52 of the sander support bracket 48 using one or more threaded fasteners 76 such as bolts or screws. The threaded fasteners 76 extend through bore holes in the depth adjustment plate 74 and into threaded apertures on the lower portion 52 of the sander support bracket 48.

The depth adjustment mechanism 70 also includes one or more biasing elements such as coil springs 78, which may be located within the bore holes in the depth adjustment plate 74. The coil springs 78 bias the depth adjustment plate 74 apart from the lower portion 52 of the sander support bracket 48. Accordingly, in use, tightening the threaded fasteners 76 compresses the coil springs 78 and brings the lower portion 52 and depth adjustment plate 74 closer together to reduce the lateral offset 72. In contrast, loosening the threaded fasteners 76 allows the coil springs 78 to expand and push the lower portion 52 and depth adjustment plate 74 further apart to increase the lateral offset 72. While the illustrated embodiment includes the coil springs 78, the depth adjustment mechanism could include other types of biasing elements such as resiliently compressible spacers (e.g. made from foam or rubber).

As shown, the depth adjustment plate 74 may be coupled to both sanders 18 through respective sander support brackets 48. In other embodiments, there may be separate depth adjustment plates for each sander, or alternatively, there may be more than two sanders mounted to a single depth adjustment plate.

In other embodiments, the depth adjustment mechanism 70 could have other configurations. For example, the depth adjustment mechanism 70 could include linear actuators or other devices for adjusting the lateral offset 72.

Referring to FIGS. 3 and 4, the apparatus 10 may include a counter-balance mechanism 80 for supporting the sanders 18 as they travel along the vertical path. The counter-balance mechanism 80 may include a hydraulic or pneumatic cylinder. One end of the counter-balance mechanism 80 may be attached to a stationary support member, such as at the base of the vertical guide 40. The other end of the counter-balance mechanism 80 may be attached to the slider block 38 or another portion of the apparatus 10 that moves with the sander 18 such as the depth adjustment plate 74.

The counter-balance mechanism 80 applies a biasing force upwards on the slider block 38. This upward force is configured to counteract some or all of the weight of the sanders 18, the slider block 38, the sander support brackets 48, and the depth adjustment plate 74. This can reduce loading on the linear actuator 20, which can help provide smoother operation and movement of the sanders 18.

Referring to FIG. 3, in some embodiments, the support surface 14 may include a low-friction coating 90 applied to the base 12. Coating 90 provides the support surface 14 with a low coefficient of friction, which may make it easier to move the panel 22 along the support surface 14.

In other embodiments, the support surface 14 may be a conveyor surface such as a conveyor belt. In such cases, the conveyor surface may have a non-slip surface that feeds the panel 22 therealong.

Figure 6:
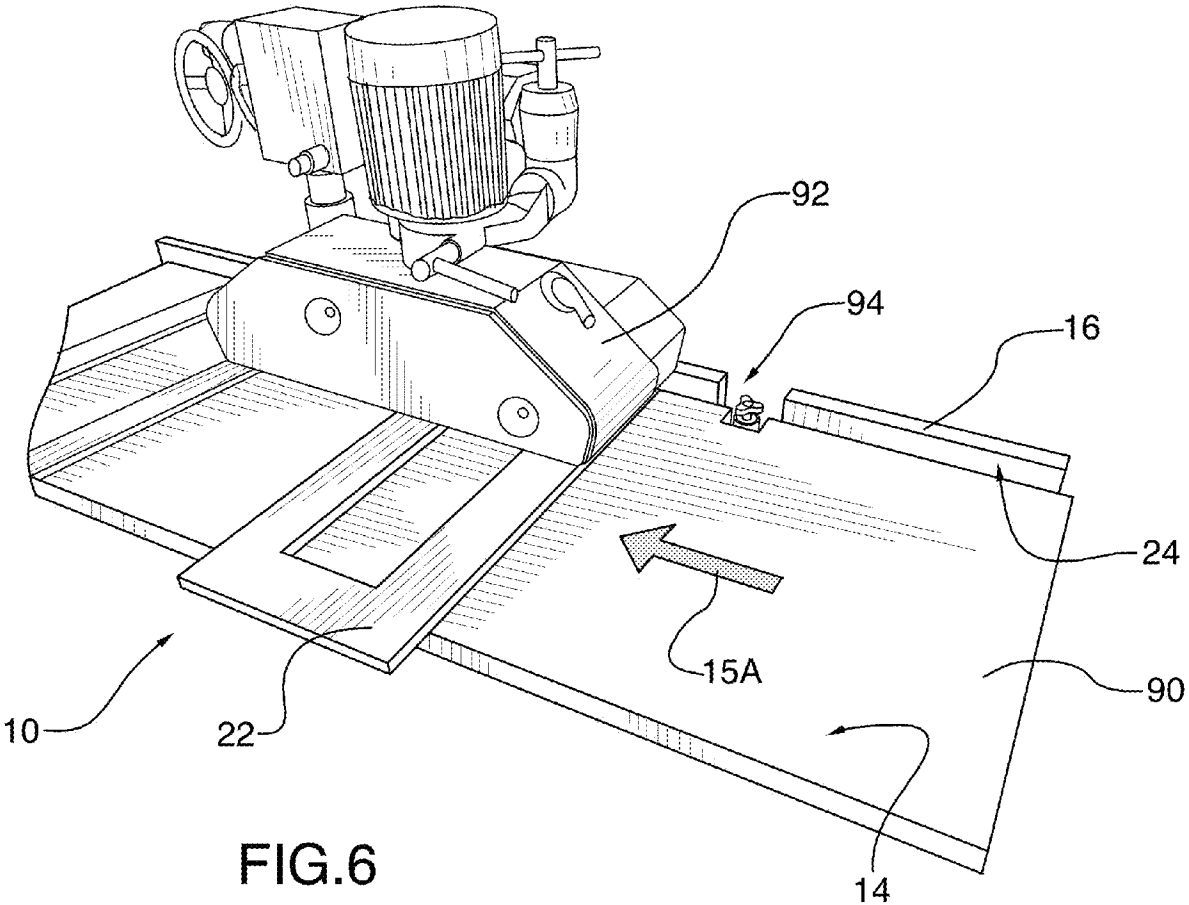
FIG. 6 is a front perspective view of the apparatus of FIG. 1 with an automatic feeder and a router according to another embodiment.

Referring now to FIG. 6, in some embodiments the apparatus 10 may include an automatic feeder 92. The feeder 92 may automatically move the panel 22 along the support surface 14 and the guide surface 24 while sanding the panel edge 23. As shown, the feeder 92 is configured to move the panel along a feed direction 15A that is opposite to the feed direction 15 shown in FIG. 1. In other embodiments, the feed direction may be reversed.

In some embodiments, the feeder 92 may include a plurality of driven rollers (not shown) for frictionally engaging the top surface of the panel 22. The rollers press down on the panel 22 with sufficient force to push or pull the panel 22 along the support surface 14. In other embodiments, the feeder 92 could have other configurations, such as conveyor belts or other feeding mechanism. In general, use of the feeder 92 can help increase throughput of the apparatus 10. Furthermore, the feeder 92 can help provide the panel 22 with a constant speed, which may provide more consistent sanding of the panel edge 23, and thus, a better finish.

The feeder 92 could also be used in conjunction with a conveyor surface to feed the panel 22 along the sanders 18.

Referring still to FIG. 6, the apparatus 10 may include a router 94 for milling or cutting a design along the panel edge 23. The router 94 is generally positioned within a slot along the fence 16. In some cases, the router 94 may be positioned upstream of the sanders 18 for cutting a design prior to sanding the panel edge 23. Alternatively, the router 94 may be positioned downstream of the sanders 18.

Figure 7:
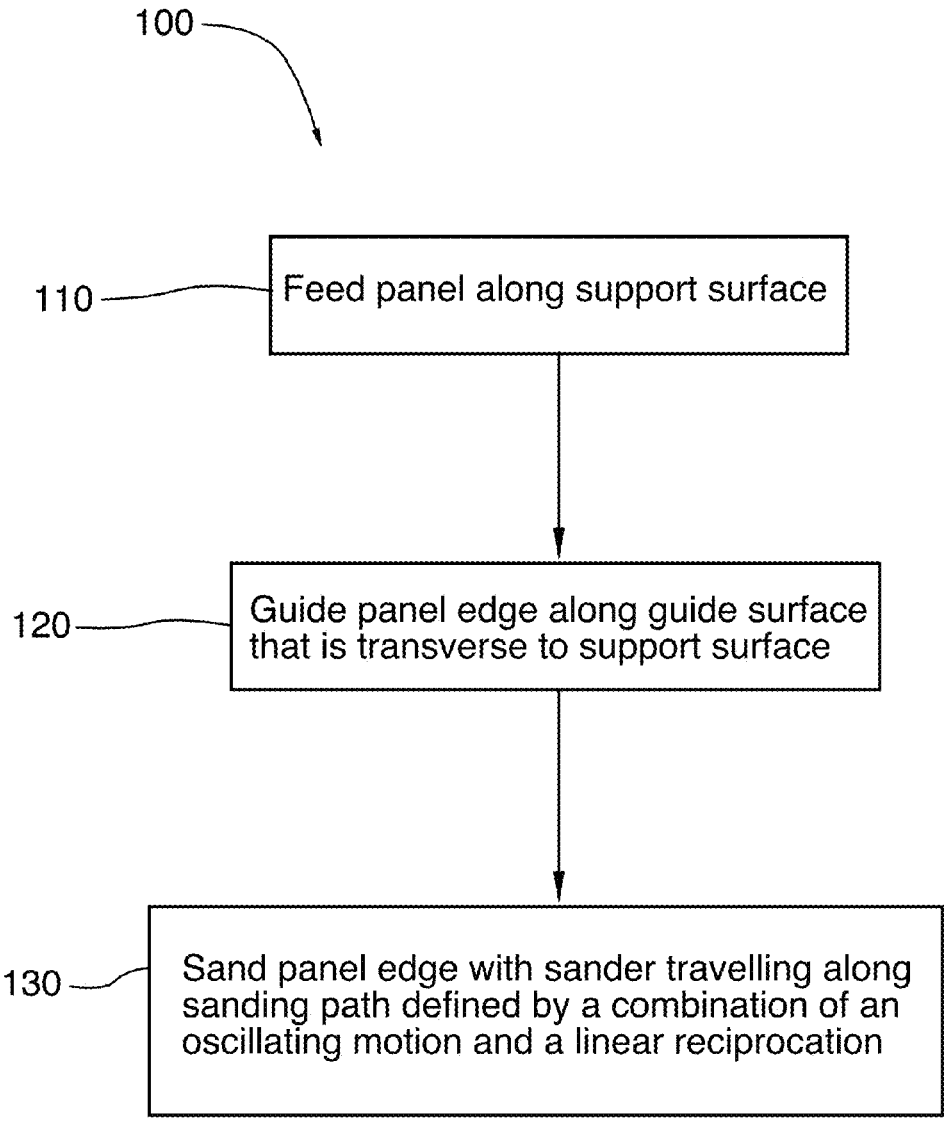
FIG. 7 is a flow diagram depicting a method for sanding the edges of a panel according to another embodiment.

Referring now to FIG. 7, illustrated therein, is a method 100 for sanding an edge of a panel according to another embodiment. The method 100 generally includes steps 110, 120, and 130.

Step 110 includes feeding the panel along a support surface. For example, step 110 may include feeding the panel 22 along the horizontal support surface 14 of the base 12.

Step 120 includes guiding the edge of the panel along a guide surface that is transverse to the support surface. For example, step 120 may include feeding the panel edge 23 along the vertical guide surface 24 of the fence 16.

Step 130 includes sanding the edge of the panel along using a sander traveling along a sanding path that is parallel to the guide surface and transverse to the support surface. For example, step 130 may include sanding the panel edge 23 using one or both of the sanders 18.

In step 130, the sanding path is defined by a combination of two distinct motions, namely, an oscillating motion having a first range of motion, and a linear reciprocation having a second range of motion. The oscillating motion with the first range of motion may be provided by oscillation of the orbital sanders 18. The oscillating motion may be a random motion, or a fixed motion in a particular path. The linear reciprocation may be provided by the crank-slider mechanism 30 or another type of linear actuator that reciprocates the sander 18 along a linear path that is distinct from the oscillating motion of orbital sander.

The second range of motion of the linear reciprocation is generally larger than the first oscillating range of motion. For example, the sanders 18 may oscillate or orbit with a first range of motion, which may be less than about 1-centimeter, or more particularly less than about 0.5-centimeters. In contrast, the crank-slider mechanism 30 may reciprocate the sanders 18 with a second range, which may be greater than 1-centimeter, or more particularly up to about 10-centimeters.

In some embodiments, the oscillating motion may have an oscillating frequency and the linear reciprocation may have a reciprocating frequency that is less than the frequency of the oscillating motion. For example, the oscillating motion of the sanders 18 may be greater than about 100-hertz, or more particularly greater than about 1,000-hertz. In contrast, the reciprocating frequency of the linear actuator 20 may be less than about 10-hertz, or more particularly less than about 1-hertz. For example, the rotor may be operated by a variable speed motor that rotates at between about 25-RPM and 100-RPM (e.g. between about 0.4-hertz and 1.7-hertz). The motor could be continuously variable speed, or could have incremental variable speeds.

In some embodiments, step 130 may include sanding the edge of the panel with a first sander having a first grit, and a second sander having a second grit. For example, with reference to FIG. 1, in step 130 the panel edge 23 may be sanded first by the left sander 18, which may have a coarser grit than the subsequent right sander 18.

In some embodiments, steps 110, 120, 130 may occur generally contemporaneously with each other.

In some embodiments, the method 100 may be carried out automatically. For example, the panel 22 may be fed automatically along the support surface (e.g. using the automatic feeder 92 or a conveyor surface). In other embodiments, the panel 22 may be manually fed along the support surface (e.g. by hand).

The apparatus and methods described herein can be particularly beneficial for sanding edges of panels such as kitchen cupboards. For example, when painting kitchen cupboards, the panel edges may be sanded prior to applying primer paint. This may reduce the amount of paint used to coat the panel edge. Furthermore, the panel edge may be sanded after the primer and between subsequent coatings of paint. In this case, the sanders may remove a particular amount of paint without removing the entire coating of paint (e.g. only about 0.005-inches of material may be removed). This process may help provide the kitchen cupboard with an edge that is flat, square to the front and back of the panel, and evenly coated with paint.

While the embodiments herein generally relate to sanding edges of kitchen cupboard that are made from wood or MDF panels, the apparatus and methods could be used to sand edges of other panels (e.g. acrylic panels or other plastic panels), which may or may not be coated with paint.

While the above description provides examples of one or more apparatus, methods, or systems, it will be appreciated that other apparatus, methods, or systems may be within the scope of the claims as interpreted by one of skill in the art.

The invention claimed is:

1. An apparatus for sanding an edge of a panel, the apparatus comprising:

(a) a base having a horizontal support surface for supporting the panel;

(b) a fence mounted to the base and having a vertical guide surface for engaging the edge of the panel, the fence having at least one vertical slot along the vertical guide surface;

(c) at least one orbital sander positioned within the vertical slot for sanding the edge of the panel; and (d) a linear actuator for reciprocating the orbital sander within the vertical slot along a vertical path.

2. The apparatus of claim 1, wherein the orbital sander comprises at least two orbital sanders.

3. The apparatus of claim 2, wherein the at least two orbital sanders have different sanding grits.

4. The apparatus of claim 1, further comprising a depth adjustment mechanism for adjusting a lateral offset between the orbital sander and the vertical guide surface.

5. The apparatus of claim 4, wherein the orbital sander is mounted within a sander support bracket, and wherein the depth adjustment mechanism includes:

(a) a depth adjustment plate positioned laterally adjacent to the sander support bracket, the depth adjustment plate having at least one bore hole therethrough;

(b) at least one biasing element for biasing the depth adjustment plate apart from the sander support bracket; and (c) at least one threaded fastener extending through the bore hole and being adjustably threaded into the sander support bracket for counteracting the biasing element and for adjusting lateral separation between the depth adjustment plate and the sander support bracket.

6. The apparatus of claim 1, wherein the linear actuator is a crank-slider mechanism for reciprocating the orbital sander along the vertical path.

7. The apparatus of claim 6, wherein the crank-slider mechanism comprises:

(a) a vertical guide;

(b) a rotor for generating rotary motion;

(c) a connecting arm having a proximal end pivotally coupled to the rotor and a distal end; and (d) a slider block pivotally coupled to the distal end of the connecting arm and slidably mounted along the vertical guide, the orbital sander being mounted to the slider block for reciprocating the orbital sander within the vertical slot along the vertical path in response to the rotary motion of the rotor.

8. The apparatus of claim 1, further comprising a counterbalance mechanism for supporting the orbital sander along the vertical path.

9. The apparatus of claim 1, further comprising a router positioned along the vertical guide surface for routing the panel.

10. The apparatus of claim 1, further comprising an automatic feeder for feeding the panel along the vertical guide surface.

11. An apparatus for sanding a panel, the apparatus comprising:

(a) a base having a support surface for supporting the panel;

(b) a fence having a guide surface transverse to the support surface of the base for engaging an edge of the panel, the fence having a sanding slot along the guide surface;

(c) a sander positioned within the sanding slot for sanding the edge of the panel, the sander being configured to oscillate with a first range of motion; and (d) a linear actuator for reciprocating the sander within the sanding slot along a linear path that is parallel to the guide surface, the linear actuator having a second range of motion that is greater than the first range of motion.

12. The apparatus of claim 11, wherein the support surface is horizontal.

13. The apparatus of claim 11, wherein the guide surface is vertical.

14. The apparatus of claim 11, wherein the sander is an orbital sander.

15. The apparatus of claim 11, wherein the linear path is a vertical path.

16. A method for sanding an edge of a panel, the method comprising:

(a) feeding the panel along a support surface;

(b) guiding the edge of the panel along a guide surface that is transverse to the support surface; and (c) sanding the edge of the panel using a sander traveling along a sanding path that is parallel to the guide surface and transverse to the support surface, the sanding path being defined by a combination of:

(i) an oscillating motion having a first range of motion, and (ii) a linear reciprocation having a second range of motion that is greater than the first range of motion.

17. The method of claim 16, wherein the sanding step includes:

(a) sanding the edge of the panel with a first sander having a first grit, and (b) sanding the edge of the panel with a second sander having a second grit.

18. The method of claim 17, wherein the first grit is more coarse than the second grit.

19. The method of claim 16, wherein the sander is an orbital sander that provides the oscillating motion, and wherein the linear reciprocation is provided by movement of the orbital sander along a linear path that is distinct from the oscillating motion of the orbital sander.

20. The method of claim 16, wherein the oscillating motion has a first frequency and the linear reciprocation has a second frequency that is less than the first frequency.

* * * * *